US008733572B2

(12) United States Patent
Ruiz Carmona

(10) Patent No.: US 8,733,572 B2
(45) Date of Patent: May 27, 2014

(54) BOX FOR PACKAGING AND TRANSPORTING PRODUCTS

(76) Inventor: Manuel Ruiz Carmona, Pilar de la Horadada (ES)

( * ) Notice: Subject to any disclaimer, the term of this patent is extended or adjusted under 35 U.S.C. 154(b) by 0 days.

(21) Appl. No.: 13/289,075

(22) Filed: Nov. 4, 2011

(65) Prior Publication Data

US 2012/0103851 A1 May 3, 2012

Related U.S. Application Data

(63) Continuation of application No. PCT/ES2010/070093, filed on Feb. 19, 2010.

(30) Foreign Application Priority Data

Jul. 13, 2009 (ES) ..... 200930443

(51) Int. Cl.
*A47G 19/00* (2006.01)
*B65D 25/14* (2006.01)
*B65D 85/62* (2006.01)

(52) U.S. Cl.
USPC ..... 220/23.83; 220/495.03; 206/512

(58) Field of Classification Search
USPC ..... 220/23.83, 475, 9.4, 495, 495.03, 220/23.87, 23.91, 646, 647, 668, 607, 775; 229/162.6, 162.7, 87.08; D09/427, D09/428; 426/106; 206/509, 511, 512, 518, 206/557; D03/312, 304, 201
See application file for complete search history.

(56) References Cited

U.S. PATENT DOCUMENTS

| | | | | | |
|---|---|---|---|---|---|
| 2,839,214 | A | * | 6/1958 | Crane | 220/4.28 |
| 3,870,188 | A | * | 3/1975 | Buffett | 220/675 |
| D245,760 | S | * | 9/1977 | Box | D3/314 |
| D257,478 | S | * | 11/1980 | Carroll et al. | D3/307 |
| 4,915,291 | A | | 4/1990 | Galber | |
| 5,465,901 | A | * | 11/1995 | Paine, Jr. | 229/407 |
| 6,471,062 | B2 | | 10/2002 | Usui et al. | |
| 6,491,164 | B1 | | 12/2002 | Virvo | |
| 6,740,346 | B2 | * | 5/2004 | Shapiro | 426/124 |
| 7,832,585 | B2 | * | 11/2010 | Sambrailo | 220/23.86 |
| 2007/0205191 | A1 | | 9/2007 | Pyle et al. | |
| 2008/0264939 | A1 | * | 10/2008 | Bray et al. | 220/9.1 |
| 2011/0011857 | A1 | * | 1/2011 | Mele | 220/23.83 |

FOREIGN PATENT DOCUMENTS

| | | |
|---|---|---|
| DE | 2 405 875 | 8/1974 |
| DE | 3434174 | 3/1986 |
| DE | 201 18 076 | 2/2003 |
| EP | 0 510 790 | 10/1992 |

(Continued)

OTHER PUBLICATIONS

Supplementary European Search Report issued Oct. 30, 2012 in corresponding European Application No. 10 79 9468.

(Continued)

*Primary Examiner* — Bryon Gehman
*Assistant Examiner* — Shawn M Braden
(74) *Attorney, Agent, or Firm* — Wenderoth, Lind & Ponack, LLP

(57) ABSTRACT

A box for packaging and transporting products essentially made from plastic, designed to contain, within, different products, such as fruit and vegetables. The box includes a lightweight supporting structure and a package made up by a laminar body that is placed against the inside or outside of the lateral walls and base of the supporting structure, the laminar body being connected to at least one of the elements that make up the supporting structure.

13 Claims, 2 Drawing Sheets

(56) References Cited

FOREIGN PATENT DOCUMENTS

| | | |
|---|---|---|
| EP | 1 081 053 | 3/2001 |
| FR | 1 256 341 | 3/1961 |
| FR | 2 235 594 | 1/1975 |
| FR | 2 862 283 | 5/2005 |
| GB | 2 163 132 | 2/1986 |
| WO | 2007/120966 | 10/2007 |
| WO | 2008/054054 | 5/2008 |

OTHER PUBLICATIONS

International Search Report issued May 19, 2010 in International (PCT) Application No. PCT/ES2010/070093.

* cited by examiner

BOX FOR PACKAGING AND TRANSPORTING PRODUCTS

This application is a Continuation of international application PCT/ES2010/070093, filed Feb. 19, 2010, which is hereby incorporated by reference in its entirety.

FIELD OF THE INVENTION

The present invention, as stated in the title of this specification, refers to a box for packaging and transporting products which can be either made from plastic material or other single-block or foldable material, with the addition of including a lightweight supporting structure, on which a laminar body, that is arranged in correspondence with the elements that make up the base and lateral walls, is adjusted outside or inside. The product contained inside the box basically connecting with said laminar body.

Thus, the object of the invention is a light weighted practical box and which is made up by a supporting structure and a laminar body adapted to the inside or the outside of that supporting structure.

BACKGROUND OF THE INVENTION

Today boxes for packing and transporting products are known, most notably those made from rigid plastic materials provided with small through holes for ventilation.

These boxes often have the disadvantage that they are too heavy for their intended role that is none other than housing within different products for their packaging and transportation, such as fruits, vegetables and the like.

SUMMARY OF THE INVENTION

The box for packaging and transporting products which is the object of the invention can be manufactured with plastic materials or other single-block materials or even foldable materials, characterized in that it comprises a lightweight supporting structure, on which is incorporated by thermal welding, adhesive or other appropriate attachment means, an inner or outer package formed by a thin laminar body preferably made from plastic material (blind or perforated) that acts as a support for the product to be packaged.

Thus, the package above mentioned is placed against the elements that make up the supporting structure.

With this, the assembly of the box of the invention is much lighter compared to other boxes completely made from conventional rigid material, namely up to 40% less weight.

This entails that, by using much less plastic raw material, the manufacturing costs are substantially reduced. Derived from this fact, also the costs for recycling the box are substantially lower, because of the lower weight of the polymer to be treated.

Moreover, the film or laminar body that acts as an inner or outer support, can act as an advertising and/or ornamental support, which allows a complete customization of the box of the invention.

Another advantage of the invention at hand is that due to a substantial decrease in the thickness of the walls of the package, its capacity is enhanced, without adversely affecting the strength and stiffness thereof as it is complemented with the elements of the supporting structure.

Quantitatively, a current plastic single-use box with dimensions of 60×40×18 cm has an approximate weight of 1 kg., whereas the embodiment covered by the present invention only weights 350 gr.

Another interesting comparison is that for crushing 1000 kg. of recycled plastic is necessary an electrical cost of about 400 kW, so that this can crush 1,333 of current units, while in comparison with the same energy up to 3,500 units of the boxes of the invention at hand could be processed.

On the other hand, it should be also noted that in current plastic boxes, the decor is just pad printing, which means that each color in this system must have a stamp, while in the case of the invention at hand, the laminar body making up the package may be screen printed with many colors, as needed.

The minimum thickness of a current single-use package is preferably 2 mm, while in the embodiment of the invention the laminar body has a thickness between 25 and 50 microns. Being translated to weight and by way of example, in the previous case within a box of 60×40×18 cm, an extra 0.5 kg. of oranges could fit, for example.

Next to provide a better understanding of this specification and being an integral part thereof, some figures in which the object of the invention has been represented in an illustrative and not limitative manner are attached.

DETAILED DESCRIPTION OF THE INVENTION

Figure 1:
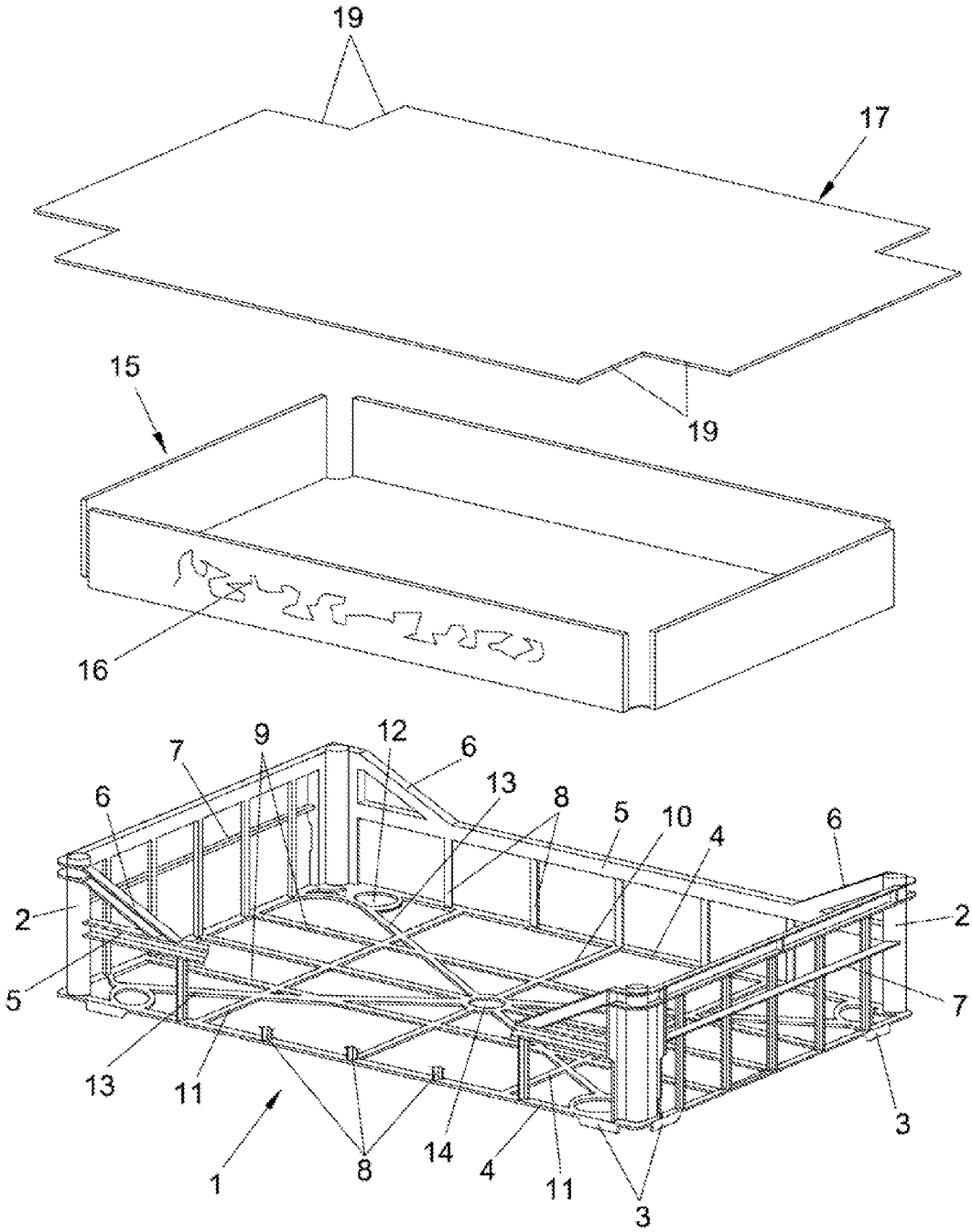
FIG. 1 shows an exploded perspective view of the box for packaging and transporting products object of the invention.
Figure 2:
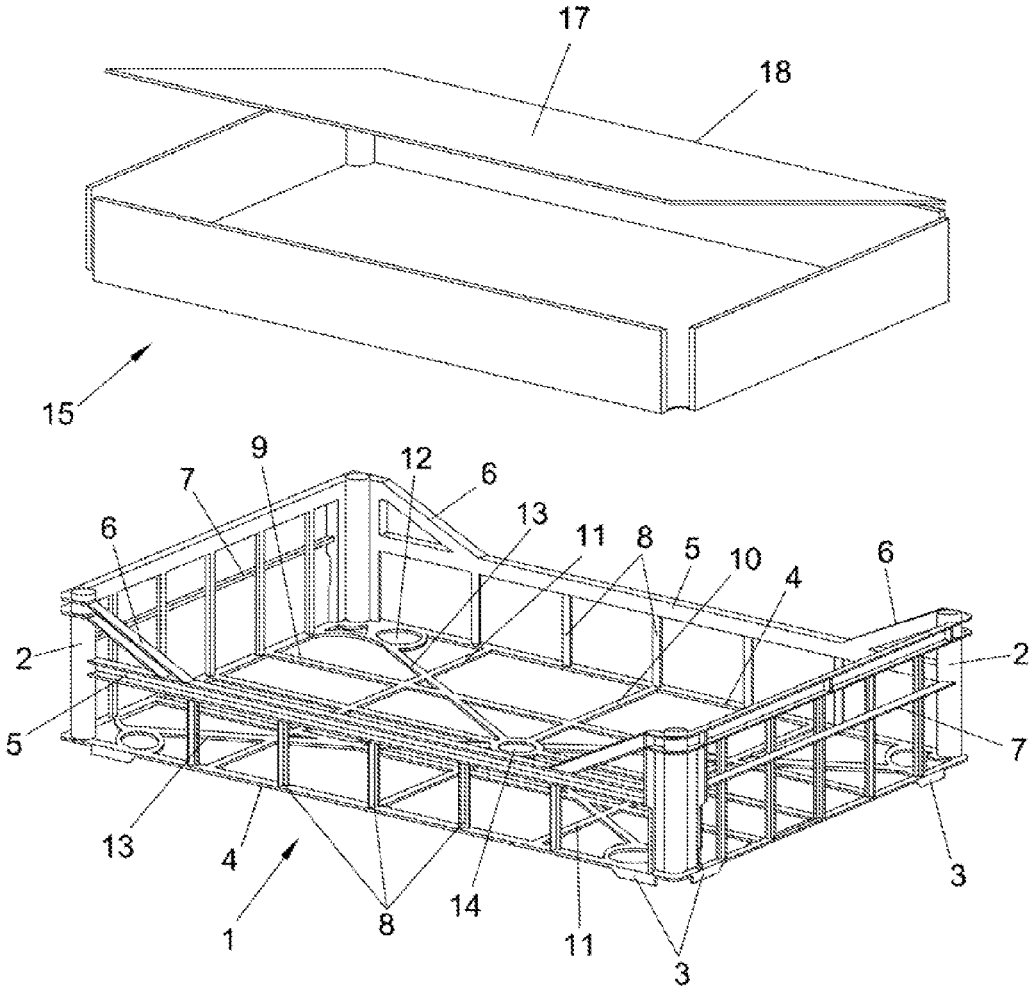
FIG. 2 shows another embodiment of the box for packaging and transporting products.

Considering the numbering adopted in the figures, the box for packaging and transporting products is determined from a supporting structure 1 made from a plastic comprising a base or bottom and lateral walls, two majors or sides and two minors or headwalls, which converge in certain corner areas determined by corner tubular columns 2 with lower supports 3, so that at the confluence of the base and lateral walls of this supporting structure 1 there are longitudinal ribs 4 that converge on the corner tubular columns 2, while the lateral walls of said supporting structure 1 include other upper longitudinal ribs 5 which also converge in these corner tubular columns 2. In turn, the major lateral walls include inclined end portions 6 departing from the upper longitudinal ribs 5 and which also end in the corner tubular columns 2.

The front walls of the supporting structure 1 have a higher height than the sides and have other intermediate longitudinal ribs 7 also joined through their ends to the corner tubular columns 2, which may also be solid, although this option is not the most recommended because weight is added to the supporting structure 1.

On the other hand, the lateral walls of the supporting structure 1 include several vertical ribs 8 joined through their ends to the different longitudinal ribs 4, 5 and 7, which converge on the corner tubular columns 2, as stated earlier.

The base comprises elongated ribs 9 which are joined through their ends to the lower ribs 4 of the head walls and other transverse ribs: one central and two lateral ones 10 joined through their ends 11 to the lower longitudinal ribs 4 of the sides.

The base also includes closed formations 12 adjacent to its vertices, while also including other diagonal ribs 13 broken by a central ring 14 which also disrupts the central transverse rib 10. In turn, the curved end sections of the diagonal ribs 13 are joined to the closed formations 12 and also to the lower longitudinal ribs 4 of the head walls of the supporting structure 1.

The upper longitudinal ribs 5 of the lateral walls, as well as the inclined end portions 6 have a "C"-shaped section which further strengthens the supporting structure 1.

This supporting structure 1 is complemented with a package 15 formed by a thin laminar body (plastic film) that is placed against the inside or outside of that supporting structure 1, the elements of the lateral walls and base of said supporting structure 1 being joined by thermal welding, adhesive or other suitable means.

The package 15 formed by the laminar body can include decorative and/or advertising elements 16, allowing a complete customization of the whole box.

There has been also foreseen the inclusion of a laminar cover 17 for covering the product when it is inside the box, the laminar cover 17 may be a separate piece or be hinged by a weakening line 18 to the package 15 placed against the inside or outside of the supporting structure 1.

Finally, it should be noted that laminar cover 17 may include corner cuts 19.

The invention claimed is:

1. A box for packaging and transporting products, the box comprising:

a supporting structure comprising head walls, lateral walls, a base and corners at which the lateral walls and head walls come together, with lower supports being included under the corners; and a package formed by a thin laminar body placed against the lateral walls, the head walls and the base of the supporting structure, wherein the lateral walls, the head walls, and the base are made up of ribs, and the lateral walls and the head walls include lower longitudinal ribs, wherein the corners of the supporting structure are tubular columns, wherein the base of the supporting structure comprises:

elongated ribs that are joined through their ends to the lower longitudinal ribs of the head wall;

transverse ribs including a central transverse rib and at least two lateral transverse ribs joined through their ends to the lower longitudinal ribs of the lateral walls of the supporting structure;

a central ring that disrupts the central transverse rib;

circular closed formations adjacent to the lower supports of the supporting structure; and diagonal ribs each having one end that terminates at a curved end section thereof and another end that terminates in the central ring, and wherein the diagonal ribs are joined to the lower longitudinal ribs of the head walls of the supporting structure by the curved end sections, and the diagonal ribs are joined to the lateral walls by the circular closed formations.

2. The box for packaging and transporting products, according to claim 1, wherein the lateral walls of the supporting structure comprise upper longitudinal ribs in a "C" shape and inclined ribs.

3. The box for packaging and transporting products, according to claim 2, further including a laminar cover arranged in correspondence with a mouth of the box.

4. The box for packaging and transporting products according to claim 1 wherein front walls of the supporting structure comprise intermediate ribs and upper ribs.

5. The box for packaging and transporting products, according to claim 1, wherein the box comprises a laminar cover arranged in correspondence with a mouth of the box.

6. The box for packaging and transporting products, according to claim 5, wherein the laminar cover is an independent body.

7. The box for packaging and transporting products, according to claim 6, wherein the laminar cover includes cut corners.

8. The box for packaging and transporting products, according to claim 5, wherein the laminar cover is a piece attached to the package by a weakening line.

9. The box for packaging and transporting products, according to claim 8, wherein the laminar cover includes cut corners.

10. The box for packaging and transporting products, according to claim 5, wherein the laminar cover includes cut corners.

11. The box for packaging and transporting products, according to claim 1, wherein the package includes advertising or ornamental elements.

12. The box for packaging and transporting products, according to claim 1, wherein the laminar body, forming the package, is placed inside the supporting structure.

13. The box for packaging and transporting products, according to claim 1, wherein the laminar body, forming the package, is placed outside the supporting structure.

* * * * *